US007406904B2

(12) United States Patent
Antal et al.

(10) Patent No.: US 7,406,904 B2
(45) Date of Patent: Aug. 5, 2008

(54) CUTTING ASSEMBLY FOR ROLLED WEB MATERIALS

(75) Inventors: Keith E. Antal, Valatie, NY (US); Michael Tucker, Valatie, NY (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 10/641,646

(22) Filed: Aug. 15, 2003

(65) Prior Publication Data

US 2005/0034584 A1 Feb. 17, 2005

(51) Int. Cl.
*B26D 5/10* (2006.01)
*B26D 1/04* (2006.01)

(52) U.S. Cl. ..... 83/614; 83/649; 83/455; 83/578; 83/175; 225/42

(58) Field of Classification Search ..... 83/614, 83/611, 375, 374, 175, 821, 570, 455, 578, 83/471.2, 647, 649, 949; 225/42, 39, 49, 225/43, 31, 47, 46, 56, 65, 77, 25, 26; 30/294, 30/317; 221/31
See application file for complete search history.

(56) References Cited

U.S. PATENT DOCUMENTS

| | | | | |
|---|---|---|---|---|
| 2,420,460 | A | 5/1947 | Bowdin et al. | |
| 2,823,969 | A | 2/1958 | Traver et al. | |
| 2,921,493 | A | 1/1960 | Emmert | 83/611 |
| 3,142,217 | A * | 7/1964 | Busse | 83/375 |
| 3,370,497 | A | 2/1968 | Busse | 83/455 |
| 3,688,625 | A * | 9/1972 | Thomas et al. | 83/614 |
| 4,156,382 | A | 5/1979 | Baker | 93/33 H |
| 4,197,774 | A * | 4/1980 | Singh et al. | 83/374 |
| 4,210,043 | A | 7/1980 | Urion et al. | 83/175 |
| 4,245,536 | A | 1/1981 | Urion | 83/821 |
| 4,325,176 | A * | 4/1982 | Urion et al. | 29/450 |
| 4,608,894 | A | 9/1986 | Lee et al. | |
| 4,787,284 | A | 11/1988 | Chen | 83/614 |
| 4,960,022 | A | 10/1990 | Chuang | 83/175 |
| 5,036,740 | A * | 8/1991 | Tsai | 83/455 |
| 5,146,828 | A | 9/1992 | Huang et al. | 83/570 |
| 5,186,376 | A | 2/1993 | Scharf et al. | 225/42 |
| 5,398,576 | A | 3/1995 | Chiu | 83/614 |
| 5,440,961 | A | 8/1995 | Lucas, Jr. et al. | 83/455 |
| 5,732,472 | A | 3/1998 | Praye | 33/42 |

(Continued)

*Primary Examiner*—Ghassem Alie
(74) *Attorney, Agent, or Firm*—Alston & Bird LLP

(57) ABSTRACT

A cutting assembly is provided that is adapted for use in combination with a container for dispensing a web of material. The dispensing container includes a plurality of adjoining sidewalls which define an external geometric profile. The cutting assembly includes a guide disposed in combination with a sidewall of the container and a cutter adapted for traversing within the elongate guide in a desired cutting direction. Furthermore, guide and bearing surfaces, formed on the guide and cutter, respectively, cooperate to permit sliding motion therebetween in the cutting direction and interlock to delimit displacement of the cutter relative to the guide in directions orthogonal to the cutting direction. A portion of the guide and cutter is disposed proximal to a corner of the container and recessed relative to its external geometric profile to facilitate container storage and display while additionally producing an aesthetically pleasing appearance. The cutting assembly may also be adapted to structurally augment the corner of the container to obviate structural flaws which may develop due to loads imposed by the cutting assembly on the container.

5 Claims, 4 Drawing Sheets

U.S. PATENT DOCUMENTS

| | | | | |
|---|---|---|---|---|
| 5,758,559 | A | 6/1998 | Capitao, Jr. et al. | 83/614 |
| 5,768,968 | A | 6/1998 | Park et al. | 83/614 |
| 5,839,634 | A | 11/1998 | Pollard et al. | 225/39 |
| 6,105,481 | A | 8/2000 | Schuler | 83/578 |
| 6,138,545 | A * | 10/2000 | Dueck | 83/614 |
| 6,223,639 | B1 | 5/2001 | Chen | 83/614 |
| 6,375,058 | B1 | 4/2002 | Passamoni | 225/49 |
| 6,405,913 | B1 | 6/2002 | Passamoni | 225/43 |
| 7,000,520 | B2 * | 2/2006 | Nichols et al. | 83/578 |
| 2002/0023526 | A1 | 2/2002 | Vegliante et al. | 83/614 |
| 2002/0117038 | A1 | 8/2002 | Vegliante et al. | 83/578 |
| 2004/0237746 | A1 | 12/2004 | Schultz et al. | 83/614 |
| 2005/0005755 | A1 | 1/2005 | Turvey et al. | 83/614 |
| 2005/0035133 | A1 | 2/2005 | Gerulski et al. | 221/31 |

* cited by examiner

CUTTING ASSEMBLY FOR ROLLED WEB MATERIALS

TECHNICAL FIELD

The present invention relates to cutting devices for use in combination with dispensing containers, and more particularly, to a new and useful cutting assembly which produces a low profile container geometry, strengthens/reinforces the dispensing container, produces a clean, even cut, while enhancing safety.

BACKGROUND OF THE INVENTION

Plastic wraps, metal foils and waxed papers, etc. are commonly employed to package, protect and preserve food products before and/or after preparation. These materials are typically fabricated in sheets, rolled/wrapped over a tubular structure, e.g. a cylindrical cardboard tube, and disposed/sold in an elongate box, which commonly functions as a dispenser in addition to a container for the rolled-material. The box dispenser may comprise a serrated metal strip along an edge of the box to cut/separate the material into desired lengths for use. To dispense the material, the consumer holds an end of the material in one hand and the box dispenser in the other, pulls the two apart applying tension to the material, and rotates or otherwise orients the box so as to cause the serrated cutting edge to grab and cut the material. While box dispensers of this type have and are still widely used for dispensing such materials, most consumers are familiar with (and tolerate) the various drawbacks and difficulties of such dispensing devices. Also, the application of tension may cause recoil or spring-back of the material (upon itself) requiring cumbersome (and, oftentimes, frustrating) separation/straightening of the material (into a flat sheet). The tendency for the material to spring back and fold upon itself maybe even more problematic in materials having resilient properties (i.e. a low elastic modulus) such as plastic wraps.

Other difficulties relate to the inability for such serrated cutting blades to produce a clean, even cut, i.e., parallel to the axis of the webbed material. It will be appreciated that the serrated blades, which essentially puncture the material to create aligned perforations, produce a rough or tattered edge. While shaper blades produce a cleaner cut, such blades may be hazardous inasmuch as the blades are typically mounted to an edge of the container and are exposed.

Other cutting devices employ a cutting blade attached to and slideable within a guide track. The web material is dispensed, laid across the track, and cut by passing the cutting blade edgewise through the material. While these cutting devices produce a clean, even cut, the track and blade typically protrude well beyond the exterior of the dispensing container thereby producing an unstreamlined external geometry. Aside from aesthetic drawbacks, the cutting device produces difficulties storing, packaging and stacking the dispensing containers. Inasmuch as the dispensing container typically functions as both a dispensing device and a product packaging container, integration of the cutting device into the container produces an asymmetric geometric profile and prevents organized packing or stacking of the containers for shipment or store display.

Yet another difficulty relates to the structural integration of such cutting devices with the dispensing container. As discussed earlier, serrated cutting blades are typically located and mounted along an edge of the container where the blade is supported by the compressive strength/buckling stability of a container wall. A downward load imposed on the cutting blade is reacted in compression by the underlying container wall. Track-guided cutting devices, however, typically require mounting along a planar surface and impose shear loads within the sidewall structures of a container. As such, the containers are prone to failure, particularly after multiple cycles of use, in areas subject to shear loading, e.g., corners of the container.

A need therefore exists for a cutting assembly which provides a favorable geometric profile, obviates structural flaws, produces a clean even cut through the webbed material, is aesthetically pleasing and safe for consumer use.

SUMMARY OF THE INVENTION

A cutting assembly adapted for use in combination with a container for dispensing a web of material. The dispensing container of the present invention in one embodiment includes a plurality of adjoining sidewall structures which define an external geometric profile. The cutting assembly comprises an elongate guide disposed in combination with a sidewall structure of the container and a cutter adapted for traversing within the elongate guide in a desired cutting direction. Furthermore, guide and bearing surfaces, formed on the guide and cutter, respectively, cooperate to permit sliding motion therebetween in the cutting direction and interlock to delimit displacement of the cutter relative to the guide in directions orthogonal to the cutting direction. A portion of the guide and cutter is disposed proximal to a corner of the container and recessed relative to its external geometric profile to facilitate container storage and display while additionally producing an aesthetically pleasing appearance.

The cutting assembly may also comprise a strengthening member for structurally reinforcing the corner of the container. The strengthening member may be integrally formed with the cutting assembly guide and engage a surface of at least one of the adjoining sidewalls. The strengthening member may have a substantially L-shaped cross sectional configuration and engage the exterior and/or interior surfaces of the adjoining sidewalls of the container.

BRIEF DESCRIPTION OF THE DRAWINGS

For the purpose of illustrating the invention, there is shown in the drawings various forms that are presently preferred; it being understood, however, that this invention is not limited to the precise arrangements and constructions particularly shown.

DETAILED DESCRIPTION OF THE DRAWINGS

Figure 1:
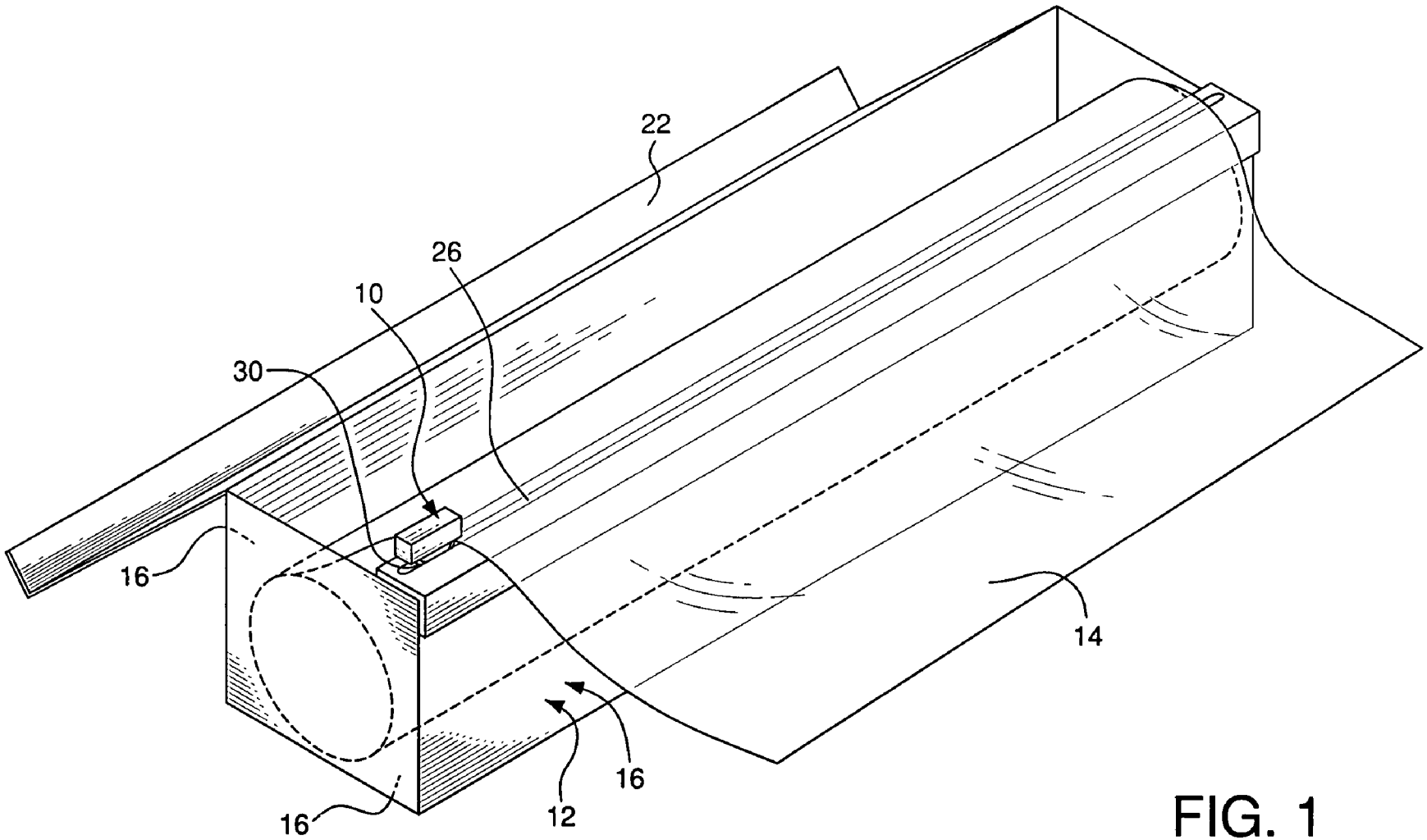
FIG. 1 is a perspective view of a cutting assembly disposed in combination with an elongate dispensing container.
Figure 2:
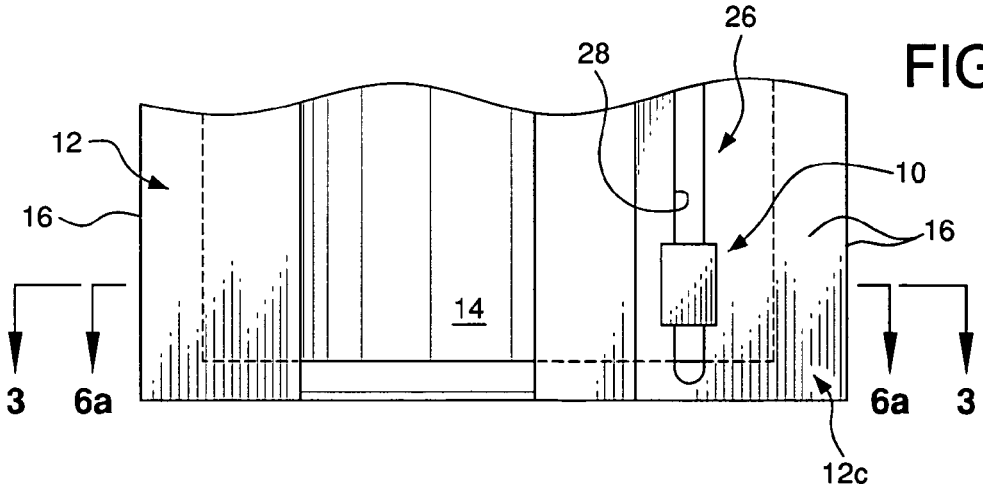
FIG. 2 is an enlarged top view of one end of the dispensing container and cutting assembly according to the present invention.
Figure 3:
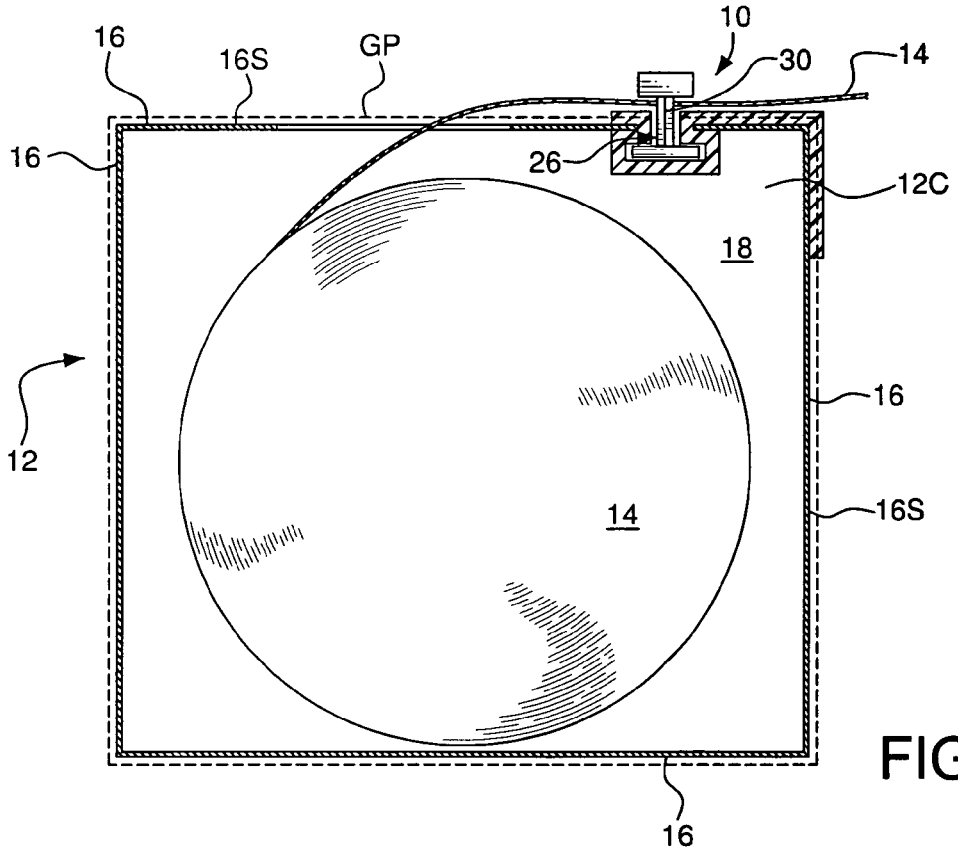
FIG. 3 is a cross sectional view taken substantially along line 3-3 of FIG. 2 depicting the cutting assembly recessed within the container and proximal to a corner of the dispensing container.

Referring now to the drawings wherein like reference numerals identify like elements, components, subassemblies etc., FIGS. 1-3 depict perspective and cross-sectional views, respectively, of an exemplary embodiment of the inventive cutting assembly 10. Specifically, the cutting assembly 10 is disposed in combination with a container 12 for dispensing sheets of webbed material 14. In the context used herein, the term "webbed product or material" means a material packaged, e.g., rolled, in preparation for being cut into lengths or strips of sheet material. Hence the terms webbed or rolled will be used interchangeably herein.

In the described embodiment, the container 12 comprises a plurality of adjoined sidewalls 16, the external surface(s) 16S thereof defining an external geometric profile GP (shown in FIG. 3). Furthermore, the sidewalls 16, in combination, define an internal chamber 18 for containing the rolled material 14. In the context used herein, the term "sidewall" means any structure, whether planar, curved etc., which functions to contain the sheet material 14. Hence, the term embraces any hinged or detachable structure such as a lid or removable top. While, in this embodiment of the invention, the adjoined sidewalls 16 define a substantially square or rectangular cross-sectional geometric profile, it should be appreciated that the invention is equally applicable to containers having other polygonal or hybrid shapes, e.g., triangular, hexagonal, trapezoidal, etc. Generally, however, the cutting assembly 10 will be employed in containers having substantially planar sidewalls which define corners at the adjoining ends.

The container 12 may contain a folding or hinged lid 22 (FIG. 1) which may be opened to access the rolled material 14, or may include an elongate opening (not depicted in the figures) for such purpose. While, in the described embodiment, the inventive cutting assembly 10 is shown in combination with a fixed portion of the container 12, the cutting assembly 10 may also be used in combination with a folding or detachable lid. An example of a lid-mounted cutting assembly 10 is described hereinafter (see FIGS. 7*a*-7*c*).

In FIGS. 2 and 3, the cutting assembly 10 is recessed into the container 12 so as to effect a low profile cross-sectional geometry. In the context used herein, the term "recessed" means that at least more than 50% of the cutting assembly is disposed within the chamber 18 and internally of the external geometric profile GP of the container 12. Further, the cutting assembly 10 is preferably disposed proximal to a corner 12C of the container 12 such that the recessed cutting assembly 10 does not interfere or bind with the webbed material 14.

Figure 4A:
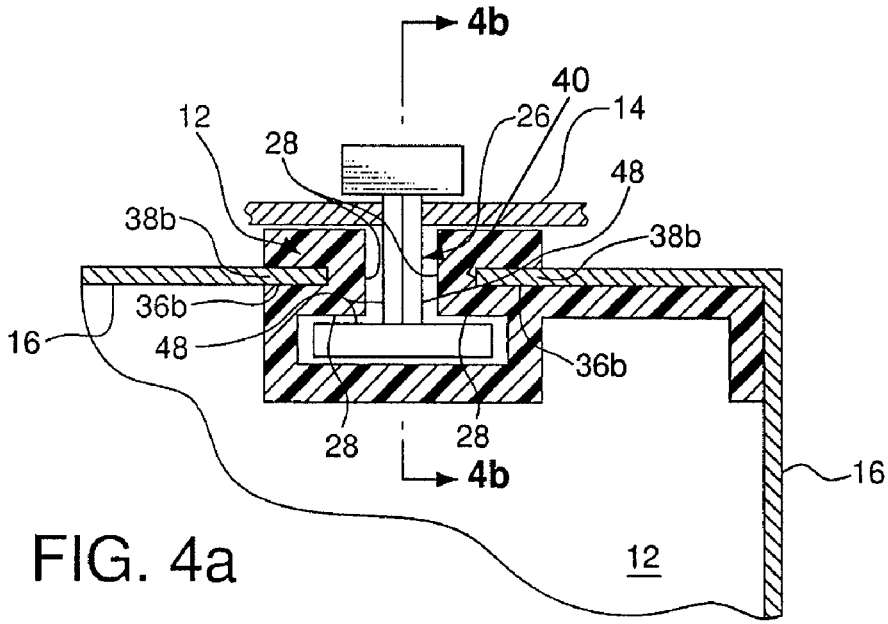
FIG. 4*a* is an enlarged view of FIG. 3 to view the guide and bearing surfaces of the cutting assembly.
Figure 4B:
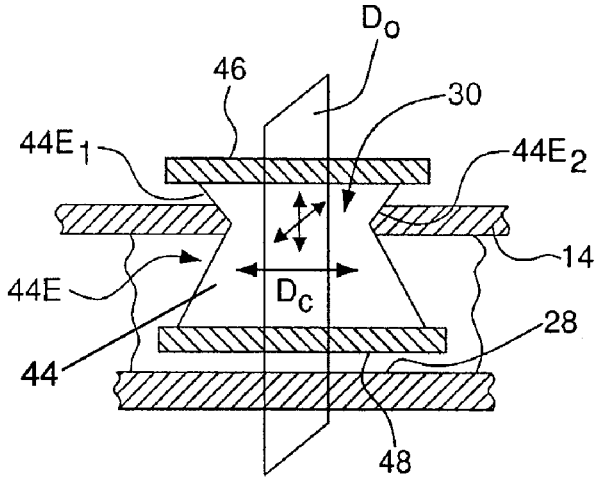
FIG. 4*b* is a cross sectional view taken substantially along line 4*b*-4*b* of FIG. 4*a*.

In FIGS. 4*a* and 4*b*, the cutting assembly 10 comprises an elongate guide 26 defining one or more guide surfaces 28 and a cutter 30 adapted for traversing relative to the guide 26 in a desired cutting direction. More specifically, the guide 26 includes back-to-back channels 36*a*, 36*b* for engaging the elongate edges 38*a*, 38*b* of an elongate slot 40 (see FIG. 2) formed within one of the container sidewalls 16. In the preferred embodiment, the elongate guide 26 is an element separate from the container 12, although, the guide 26 may be formed integrally with a sidewall 16 of the container 12 (as will be seen in an alternate embodiment of the invention).

The cutter 30 comprises a sharpened cutting blade 44 along at least one edge 44E thereof, a handle 46 disposed in combination with the cutter 30 for traversing the cutter 30 within the guide 26 and one or more bearing surfaces 48 for engaging one or more of the guide surfaces 28. In the preferred embodiment, cutting blades 44 are formed on oppositely disposed edges $\mathbf{44}E_1$, $\mathbf{44}E_2$ of the cutter 30 to facilitate cutting operations in either cutting direction within the guide 26.

The guide and bearing surfaces 28, 48 cooperate to permit sliding motion therebetween in the cutting direction (shown as an arrow $D_C$ in FIG. 4*b*) and interlock to delimit motion of the cutter 30 relative to the guide 26 in directions orthogonal to the cutting direction (shown as an plane $D_O$ in FIG. 4*b*). More specifically, in the preferred embodiment, the guide and bearing surfaces 28, 48 are aligned to facilitate linear motion of the cutter 30 relative to the guide 26 and define an inverted "T" cross-sectional configuration to perform the combined functions of limiting lateral or side-to-side displacement of the cutter 30 and limiting transverse or up and down displacement thereof. While the preferred description discloses an inverted "T" configuration, any cross-sectional configuration which delimits orthogonal displacement of the cutter 30 relative to the cutting direction can be employed. For example, an F-, L- or V-shaped configuration will also perform this function.

To improve the profile geometry of the cutting assembly 10 yet further and prior to use, it may be desirable to incorporate design features which facilitate assembly/disassembly of the cutter 30 relative to the guide 26. That is, to facilitate packaging/shipping/store display, the guide 26 may be integrated with the container 12 as described and illustrated herein (i.e., recessed and proximal to a corner of the container), however, the cutter 30 may be provided as a separate component for subsequent assembly/installation. Regarding the latter, an aperture or enlarged opening (not shown) is provided in the guide 26 to facilitate receipt and installation of the cutter 30 within the guide 26. Alternatively, the guide and bearing surfaces 28, 48 may be resilient to permit a small degree of flexure, thereby enabling the guide surfaces 28 to move apart when introducing the cutter 30 into the guide 26.

In operation, and referring collectively to FIGS. 1-4*b*, the cutter 30 is positioned at an extreme end of the elongate guide 26 (best shown in FIG. 1) so as to permit unobstructed placement of the material 14 across the guide 26. The material 14 may secured along the exterior surface of the guide 26 by means of temporary adhesive strips (not shown) disposed on either or both sides of the guide 26. The cutter 30 is then caused to traverse within the guide 26 to effect an edgewise cut through/across the width of the material 14. As discussed previously, the cutter 30 may employ cutting edges $\mathbf{44}E_1$, $\mathbf{44}E_2$ (FIG. 4*b*) along opposing edges such that the cutter 30 may operate in either direction. Furthermore, the height dimension of the cutter 30 relative to the guide 26, i.e., the portion of the blade 44 projecting above the guide 26 need only be slightly larger than the thickness dimension of the material selected to be cut. Consequently, the profile of the cutting assembly 10 can be minimized and safety maximized by employing a cutter 30 based upon these design criteria.

Figure 5:
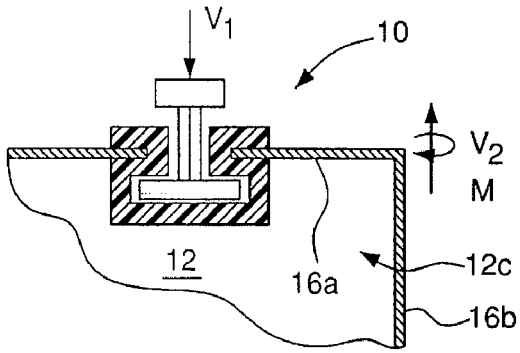
FIG. 5 is a schematic of the loads acting on the cutting assembly and being reacted in the corner of the container.

In yet another embodiment of the invention, the cutting assembly 10 is adapted to reinforce and strengthen the corner 12C of the container 12 nearest the cutting assembly 10, and more particularly, nearest the guide 26. While developing the cutting assembly 10 of the present invention, the inventors experienced difficulties as a result of loads imposed by the cutter 30 on the container 12. Specifically, in a number of instances, the corner of the container 12 failed, thereby separating the adjoining sidewalls 16*a*, 16*b*. To visualize the loads acting on the container 12 leading to failure, reference is made to FIG. 5 wherein a downward vertical load V1 is imposed on the cutting assembly 10 during cutting operations. The vertical load V1 is reacted as a vertical shear V2 and moment load M in the corner 12C of the container 12. It is this combination of loads which can lead to failure and separation of the adjoining sidewalls 16*a*, 16*b*.

Figure 6A:
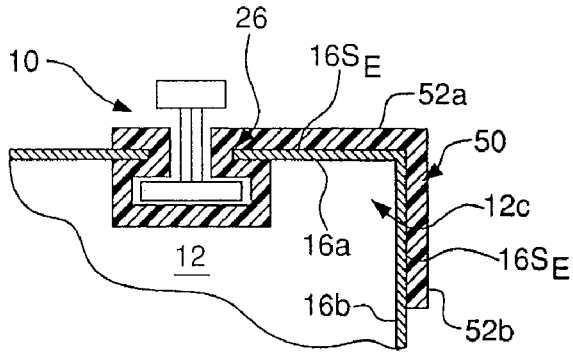
FIG. 6*a* is an enlarged cross sectional view of the cutting assembly taken substantially along line 6*a*-6*a* of FIG. 2 depicting a strengthening member disposed in combination with the exterior sidewalls of the container.
Figure 6B:
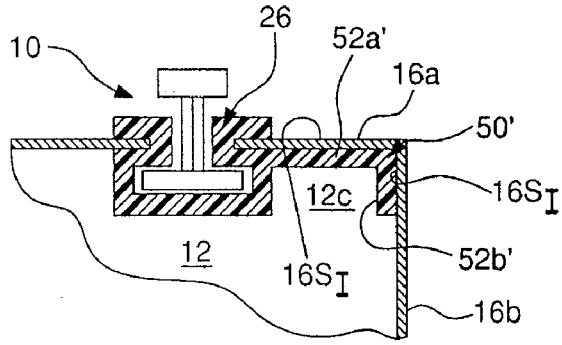
FIG. 6*b* depicts an alternate embodiment of the cutting assembly wherein the strengthening member is disposed in combination with the interior sidewalls of the container.
Figure 6C:
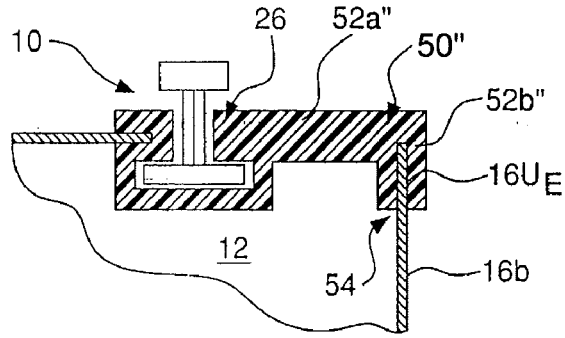
FIG. 6*c* depicts an alternate embodiment of the cutting assembly wherein the strengthening member employs a split leg for receiving the end of an adjacent sidewall of the container.

In this embodiment of the invention, and referring to FIGS. 6*a* through 6*c*, the cutting assembly 10 is modified to include a strengthening member 50 structurally augmenting the container between the guide 26 and the corner 12C. In the preferred embodiment, the strengthening member 50 is integrally formed with the guide 26, extends from the guide 26 to the corner 12C and, preferably, engages a surface 16S of one at least one of the sidewalls 16*a*, 16*b*. In FIG. 6*a*, the strengthening member 50 is substantially L-shaped wherein the legs 52*a*, 52*b* thereof are configured to mate with the exterior surfaces $\mathbf{16}S_E$ of the adjoining sidewalls 16*a*, 16*b*. Alternatively, in FIG. 6*b*, the L-shaped strengthening member 50' engage the interior surfaces $\mathbf{16}S_I$ of the adjoining sidewalls 16*a*, 16*b*. In yet another alternative embodiment shown in FIG. 6*c*, the strengthening member 50" comprises a leg 52*a*" functionally replacing a portion of one sidewall 16*a* and a split leg 52*b*" to form a deep channel 54 for accepting an upper end portion $\mathbf{16}U_E$ of an adjacent sidewall 16*b*.

In the embodiments shown, the strengthening members 50, 50', 50" may or may not be adhesively bonded to or otherwise affixed to the sidewalls 16*a*, 16*b*. When bonded, the shear and moment loads acting on the corner 12C are reacted as a function of the compressive strength of the sidewall 16*b* (reacting the vertical shear load) and of the tensile or compressive strength of the bonding adhesive (reacting the moment load). In FIG. 6*a*, when bonding the leg 52*b* to the mating exterior sidewall surfaces $\mathbf{16}S_E$, the moment load M is reacted as a tensile load (prying the leg away from the sidewall 16*b*). In FIG. 6*b*, by bonding the leg 52*b'* to the interior sidewall surfaces $\mathbf{16}S_I$, the moment load is reacted as a compressive load through the adhesive (pressing the leg 52*b'* against the sidewall 16*b*). In FIG. 6*c*, when bonding the split leg 52*b*" to the adjacent sidewall surfaces $\mathbf{16}S_E$, $\mathbf{16}S_I$, the strengthening member 50 exhibits the combined attributes of the embodiments described in FIGS. 6*a* and 6*b*.

When the strengthening member 50 is not bonded or otherwise affixed to the exterior or interior surfaces $\mathbf{16}S_E$, $\mathbf{16}S_I$, the member 50 functions to augment the reaction only one of the imposed loads, i.e., either the vertical shear load or moment load.

While the invention has been described in the context of a conventional elongate cardboard container, it should be understood that the inventive cutting assembly may be employed with any dispenser, which may or may not dispense sheet material which has been rolled. Further, while the invention has particular application to small containers typically used to dispense household products such as plastic wraps, foils or paper, the invention has utility in more sophisticated commercial/industrial applications, for example for cutting a web of material in a manufacturing environment.

The illustrated embodiments of the cutting assembly depict various components thereof which are assembled in combination with a dispensing container. However, it should be appreciated that various cutting assembly components may be formed integrally with the container. Further, it should be understood that the inventive cutting assembly may be fabricated and sold to a consumer as an assembled unit, or may be provided as an independent element and installed/assembled with the container subsequent to sale or delivery.

In summary, the structural and functional elements described herein provide the teachings necessary to design and fabricate a low profile cutting assembly for a dispensing container. Consequently, the resulting dispensing containers will facilitate packaging, storage, stacking and/or store display. Further, alternate embodiments of the cutting assembly have been described to obviate structural flaws tending to diminish the usefulness or fatigue life of such dispensing containers. Finally, the low profile cutting assembly provides a simple, pragmatic and reliable alternative to the cutting devices of the prior art.

A variety of modifications to the embodiments described will be apparent to those skilled in the art from the disclosure provided herein. Thus, the present invention may be embodied in other specific forms without departing from the spirit or essential attributes thereof and, accordingly, reference should be made to the appended claims, rather than to the foregoing specification, as indicating the scope of the invention.

We claim:

1. A cutting assembly in combination with a container for dispensing a web of material from a roll of the web, the roll having a longitudinal axis about which the web is wound, said container having a plurality of adjoining sidewalls extending parallel to the longitudinal axis and serially joined together at respective longitudinal edges of the sidewalls to form corners of the container, the sidewalls defining an external geometric profile of the container, a slot being defined in one of said sidewalls for leading the web out of an interior of the container through the slot, the cutting assembly comprising:

a guide disposed within a sidewall of the container proximate one of the corners formed between adjoining sidewalls, the guide defining at least one guide surface, the guide further including a portion disposed against an outer side of the sidewall and defining a surface facing outwardly away from the interior of the container on which the web led out through the slot is laid for cutting of the web, the guide further comprising a strengthening member extending from said guide to said corner and engaging surfaces of said adjoining sidewalls to structurally reinforce said corner; and a cutter for traversing within said guide in a desired cutting direction, and defining at least one bearing surface, said guide and bearing surfaces cooperating to permit sliding motion therebetween in said cutting direction and interlocking to delimit motion of said cutter relative to said guide in directions orthogonal to said cutting direction, at least 50% of the cutting assembly being disposed internally of the external geometric profile of the container.

2. The cutting assembly according to claim 1 wherein said strengthening member is integrally formed in combination with said guide.

3. The cutting assembly according to claim 2 wherein said strengthening member has a substantially L-shaped cross sectional configuration and engages the interior surfaces of said adjoining sidewalls.

4. The cutting assembly according to claim 1 wherein said guide and bearing surfaces define a substantially inverted T-shaped cross sectional configuration.

5. The cutting assembly according to claim 1 wherein said cutter defines cutting edges on oppositely disposed edges thereof.

* * * * *